US005088929A

United States Patent [19]

Enomoto

[11] Patent Number: 5,088,929

[45] Date of Patent: Feb. 18, 1992

[54] BOARD-TO-BOARD CONNECTON TYPE ELECTRIC CONNECTOR

[75] Inventor: Masahiro Enomoto, Inagi, Japan

[73] Assignee: Molex Incorporated, Lisle, Ill.

[21] Appl. No.: 714,484

[22] Filed: Jun. 13, 1991

[30] Foreign Application Priority Data

Jun. 22, 1990 [JP] Japan ..... 2-66546[U]

[51] Int. Cl.[5] ..... H01R 9/09

[52] U.S. Cl. ..... 439/66; 439/326

[58] Field of Search ..... 439/59, 62, 64, 65, 439/66, 74, 325, 326, 630, 634, 635

[56] References Cited

U.S. PATENT DOCUMENTS

| | | | |
|---|---|---|---|
| 3,858,154 | 12/1974 | William | 439/66 |
| 3,920,303 | 11/1975 | Pittman et al. | 439/326 |
| 4,445,735 | 5/1984 | Bonnefoy | 439/66 |
| 4,678,252 | 7/1987 | Moore | 439/326 X |

*Primary Examiner*—Neil Abrams
*Assistant Examiner*—Khiem Nguyen
*Attorney, Agent, or Firm*—Louis A. Hecht; Stephen Z. Weiss; Charles S. Cohen

[57] ABSTRACT

Disclosed is an improvement of board-to-board connection type electric connector which comprises: a terminal housing having terminals laterally arranged and fixed at regular intervals with two contact legs of each terminal exposed from the housing; a connector casing to accommodate the terminal housing loosely; means to hold the underlying printed board in contact with the lower contact legs of the terminals; and means to retain resiliently the overlying printed board in the contact position with upper contact legs of the terminals. Thus, a required electrical connection can be made without soldering numerous small terminals of the connector to printed circuits. Therefore, arrangement of numerous small terminals at narrow intervals will cause no difficulty in making a required electrical connection.

4 Claims, 4 Drawing Sheets

FIG.7
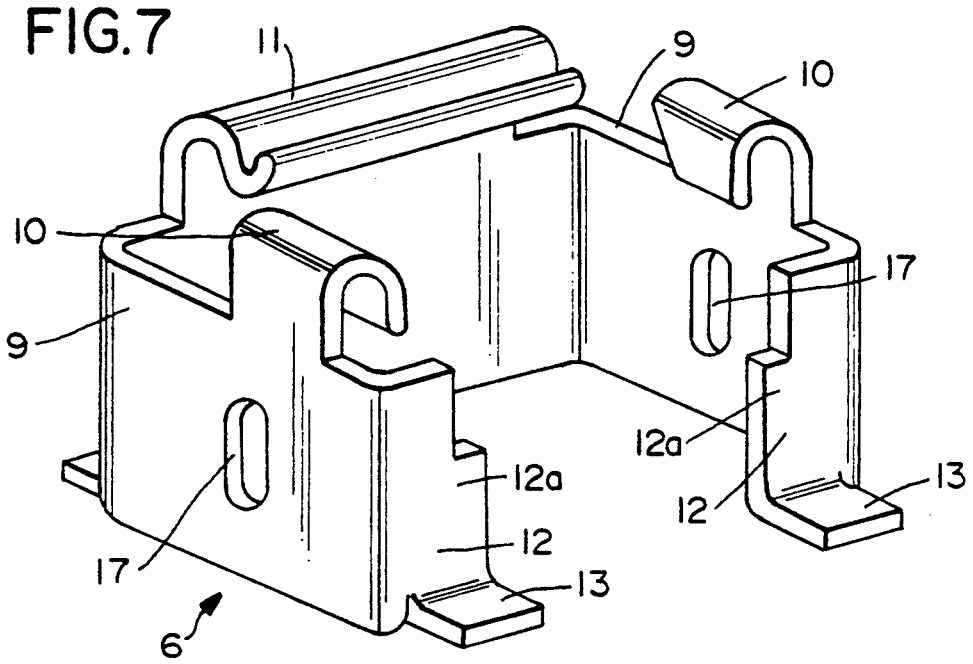
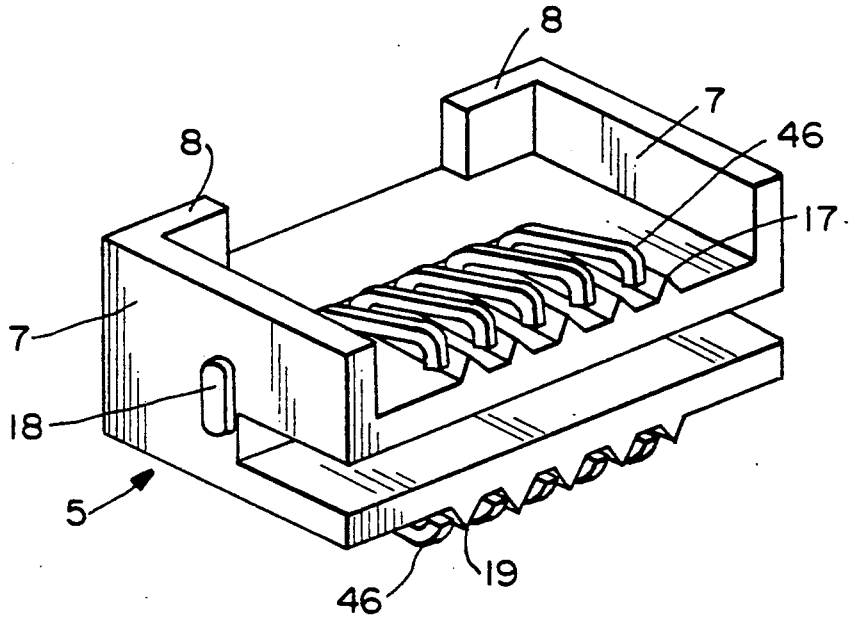
FIG.8

BOARD-TO-BOARD CONNECTON TYPE ELECTRIC CONNECTOR

FIELD OF THE INVENTION

The present invention relates to a board-to-board type electric connector, particularly an electric connector for making electric connections between electric circuits on two printed boards.

DESCRIPTION OF PRIOR ART

A variety of board-to-board type electric connectors have been used. The circuit pattern on one printed board can be connected to the circuit pattern on the other printed board with the use of such an electric connector. Usually, it has a plurality of terminals laterally arranged at regular intervals P and fixed in its housing. One leg contact of each terminal is soldered to the circuit pattern on one printed board whereas the other leg contact of each terminal is soldered to the circuit pattern on the other printed board. The housing has many terminals laterally arranged in a limited space, and because these terminals must be small, the lateral arrangement must be at very narrow intervals.

As a result of the narrow intervals, it is very difficult to solder each small terminal to selected portions of a given circuit pattern without adjacent terminals being bridged by solder. To avoid bridging, the soldering procedure becomes a time consuming and difficult task.

One object of the present invention is to provide a board-to-board type electric connector providing the electric connection between two printed boards without the use of solder. Specifically, one leg contact of each terminal is forced into electrical contact with one circuit pattern on one printed board while the other leg contact of each terminal is forced into electrical contact with one circuit pattern on another printed board. Such electrical contact is attained due to the resiliency of the terminal which assures that a stable electrical connection is made between the two printed boards.

SUMMARY OF THE INVENTION

To attain the object of the present invention an electric connector is provided for connecting circuit patterns on two printed boards comprising a terminal housing having a plurality of terminals laterally arranged and fixed at regular intervals with two leg contacts of each terminal extending from the housing. A connector casing accommodates the terminal housing loosely, permitting the terminal housing to slide up and down. The connector casing has extensions integrally connected thereto for fixing it to one printed board. The connector casing also has means to permit the other printed board to come into contact with the other leg contacts of the terminals and to retain resiliently the other printed board in contact with the other leg contact of each terminal, and, at the same, retain resiliently the one printed board in contact with one leg contact of each terminal, thus forcing the terminals into resilient electrical contact with the circuit patterns on the two printed boards.

The means to permit the other printed board to come into contact with the other leg contact of said terminals, to retain resiliently the other printed board in contact with the other leg contact of each terminal, and, at the same time, to retain resiliently one printed board in contact with one leg contact of each terminal, comprises a stopper wall integrally connected to the terminal housing, a rear retainer and opposite side retainers both integrally connected to the connector casing whereby the other printed board is inclined and inserted in the space defined by the stopper and the rear retainer, allowing the other printed board to come into contact with the stopper and the rear retainer. When the other printed board is rotated about the pivot the other printed board comes into contact with the rear retainer until the other printed board has been caught by the side retainers, thereby retaining the circuit pattern on the other printed board in resilient electric contact with the other leg contacts of the terminals.

An electric connector may further comprise means to prevent the other printed board from slipping off from said connector casing in the horizontal direction. The means may include front lateral extensions integrally connected to the connector casing, the other printed board having notched portions on its opposite sides to be caught by said front lateral extensions.

In use, first, the connector casing is fixed to one printed board with the aid of its attachment extensions. In this fixed position the terminal housing is slidable up and down in the connector casing, and is allowed to slide down on the underlying printed board so that one leg contact of each terminal is brought in contact with the circuit pattern on the underlying printed board. Then, the other printed board is inclined and inserted in the space defined by the stopper and the rear retainer until the other printed board has come into contact with the stopper and the rear retainer. Next, the other printed board is rotated about the pivot at which time it makes contact with the rear retainer and is caught by the side retainers. In the final position the circuit pattern on the other printed board is in resilient contact with the other leg contact of the terminals.

As described, the connector casing of the connector is attached to one printed board, and then the other printed board is attached to the connector casing, thereby causing all terminals to be sandwiches therebetween and resiliently pressed with one leg contact of each terminal brought in contact with the circuit pattern on the overlying printed board and with the other leg contact of each terminal brought in contact with the circuit pattern on the underlying printed board. Thus, a required electric connection is made between the overlying and underlying printed boards.

Other objects and advantages of the present invention will be understood from the following description of an electric connector according to one embodiment of the present invention.

BRIEF DESCRIPTION OF THE DRAWINGS

FIG. 7 is an isometric view of the connector casing.

FIG. 8 is an isometric view of the terminal housing.

DESCRIPTION OF PREFERRED EMBODIMENT

Figure 1:
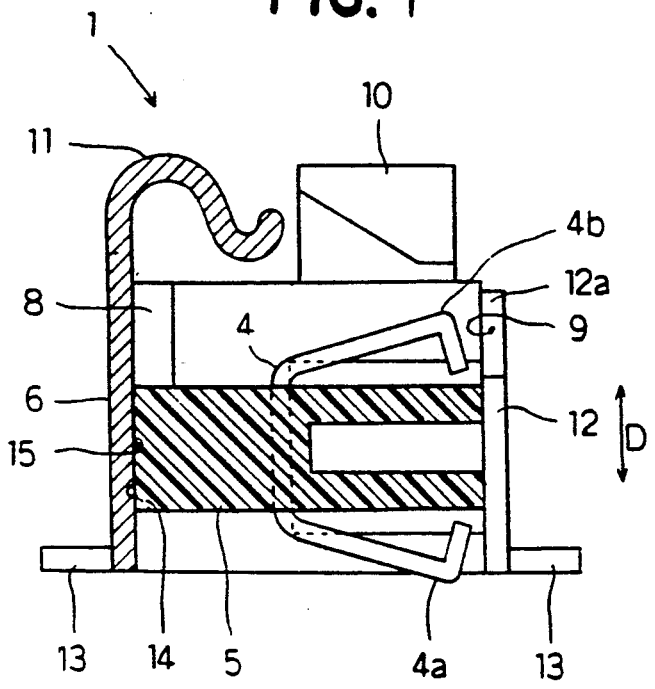
FIG. 1 is a longitudinal section of the electrical connector.

Referring to FIG. 1 there is shown, in longitudinal section, an electric connector 1 for making an electric connection between two printed boards 2 and 3. As seen from this drawing, the electrical connector 1 comprises a terminal housing 5 having a plurality of terminals 4 mounted therein, and a connector casing 6 to accommodate the terminal housing 5 loosely. Each terminal 4 has two divergent leg contacts 4*a* and 4*b* and a joint section integrally connected to the leg contacts 4*a* and 4*b*. The central joint section of each terminal 4 is fixed to the terminal housing 5 with the divergent legs 4*a* and 4*b* exposed from the terminal housing 5. A plurality of such terminals 4 are arranged laterally at regular intervals P, and are fixed to the terminal housing 5. The divergent legs 4*a* and 4*b* are resilient, and will be yieldingly converged when force is applied to the upper and lower legs 4*a* and 4*b* in vertical direction D.

The terminal housing 5 has opposite side walls 7, and stopper walls 8 are integrally connected to the opposite side walls 7. In describing the electrical connector according to this particular embodiment, one printed board 2 is described as a mother printed board having a circuit pattern thereon whereas the other printed board 3 is described as a daughter printed board having a circuit pattern thereon. The terminal housing 5 has a plurality of terminals 4 mounted therein with elongated ridges 19 parallel to and located between the divergent leg contacts 4*a* or 4*b*. These ridges 19 maintain the divergent leg contacts 4*a* and 4*b* in alignment in registration to the circuit pattern on the printed boards.

Figure 6:
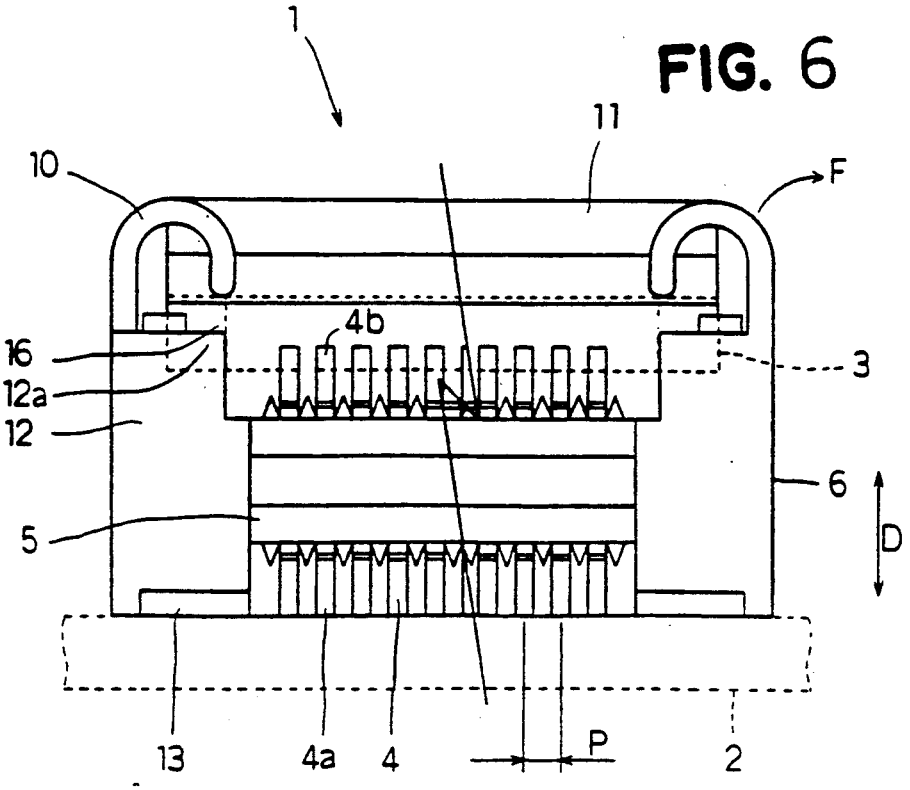
FIG. 6 is a front view of the electrical connector.

The connector casing 6 is designed to accommodate the terminal housing 5. The casing 6 has a circumferential wall 9 to surround the side walls 7 and stopper walls 8 of the terminal housing 5. The circumferential wall 9 has a pair of resilient, inverted J-shaped extensions 10 integrally connected to the top of the circumferential wall 9 (See FIGS. 6 & 7). Retainer walls 12 are integrally connected to the upper, front ends of the circumferential wall 9.

The connector casing 6 accommodates the terminal housing 5 loosely, thereby permitting the terminal housing 5 to slide up and down in the connector casing 6.

Figure 5:
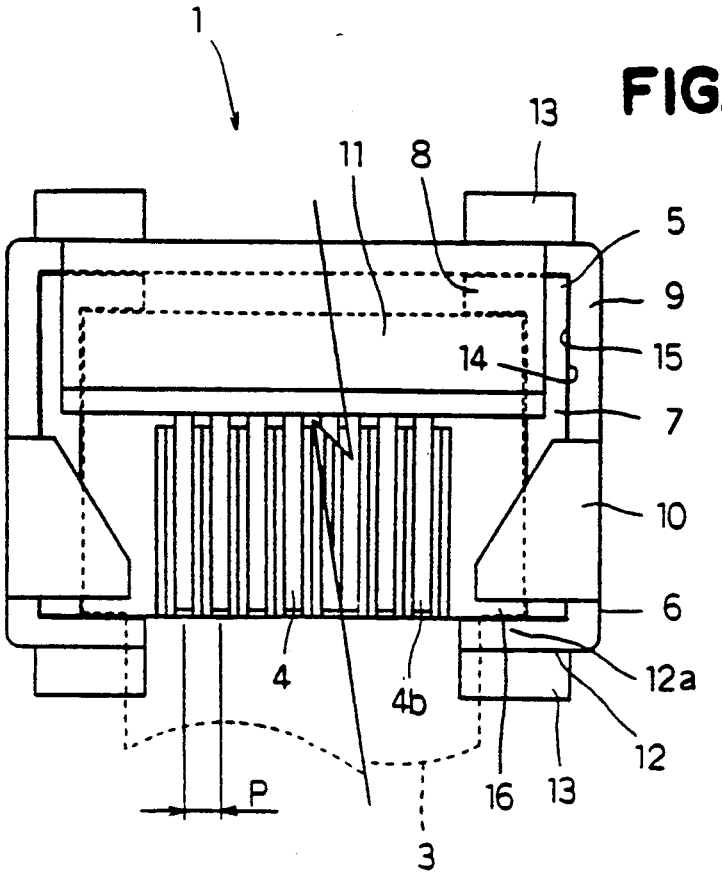
FIG. 5 is a plane view of the electrical connector.

As seen from FIG. 5, the outer surface of each of the opposite side walls 7 and the outer surface of the stopper walls 8 of the terminal housing 5 function as slide surface 14. The inner surface of the retainer walls 12 and the inner surface of the circumferential wall 9 of the connector casing 6 function as slide surface 15. The terminal housing 5 can slide relative to the connector casing 6 on their slide surfaces 14 and 15 in vertical direction D.

In place of or in addition to the flat slide surfaces 14 and 15, longitudinal slots 17 may be formed in the circumferential wall 9 of the connector casing 6. Longitudinal nibs 18 may be formed protruding from the outer surface of the terminal housing 5. The terminal housing 5 may be nested in the connector casing 6 with the nibs 18 of the terminal housing 5 slidably fitted in the slots 17 of the connector casing 6.

Figure 2:
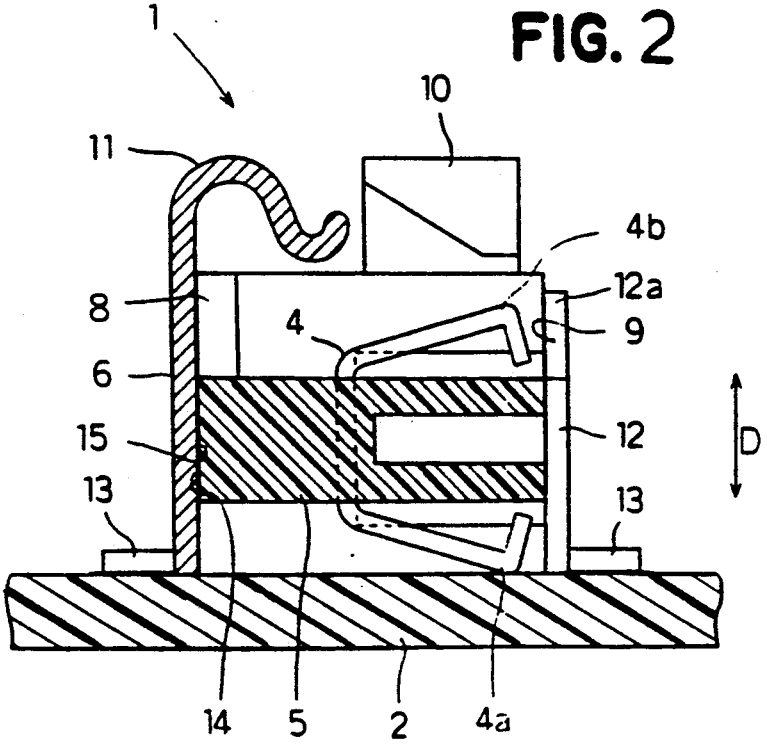
FIG. 2 is a longitudinal section of the electrical connector which is attached to one printed board.
Figure 3:
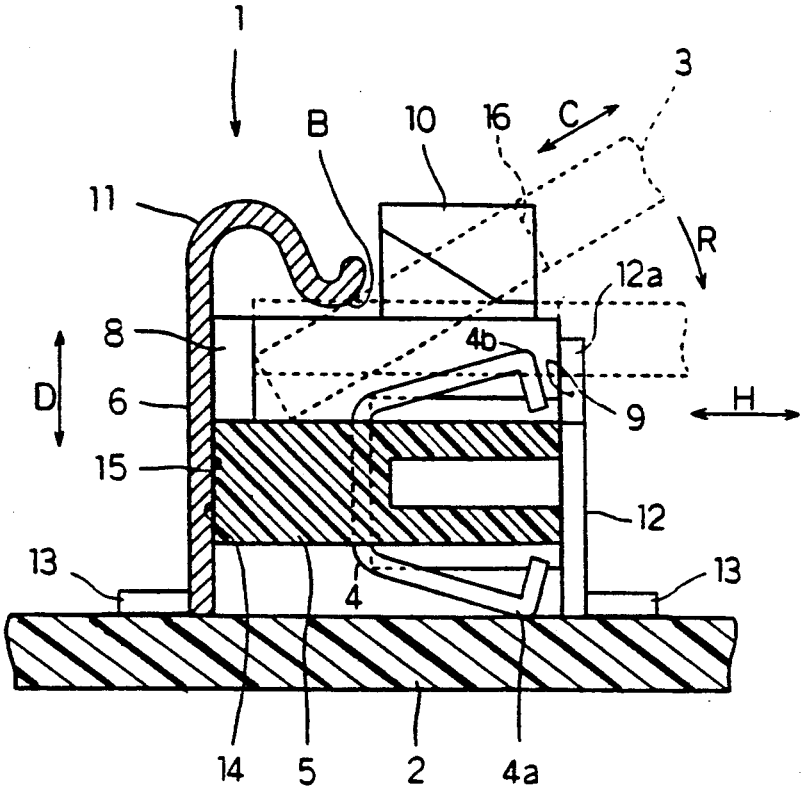
FIG. 3 is a longitudinal section of the electrical connector which is attached to one printed board, showing the manner in which the other printed board is attached to the electrical connector.
Figure 4:
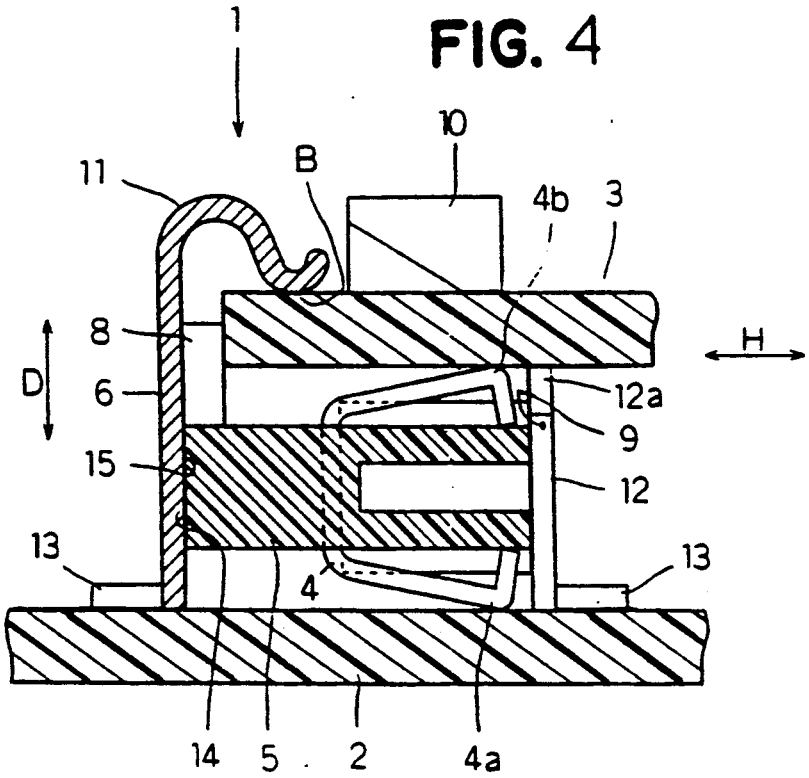
FIG. 4 is a longitudinal section of the electrical connector which has two printed boards attached thereto.

In use the connector casing 6 is attached to the mother printed board 2 with the aid of the attachment extensions 13 of the connector casing 6. The attachment extensions may be affixed to the printed board 2 by means including solder. In this fixed position the terminal housing 5 is forced upon the underlying printed board 2, thereby causing the lower leg contact 4*a* of each terminal 4 to come to contact with the circuit pattern of the underlying printed board 2 (See FIG. 2).

Next, a daughter printed board 3 is inclined and inserted in the space defined by the stopper walls 8 and the rear retainer 11, as indicated by arrows C, until the daughter printed board 3 has come to contact with the stopper walls 8 and the rear retainer 11. Then, the daughter printed board 3 is rotated about the pivot B at which time the daughter printed board 3 comes into contact with the rear retainer 11 until it has been placed in a horizontal position by moving the side retainers 10 aside and causing them to yieldingly bend backwards and thereafter by allowing them to return to their original positions and to catch the daughter printed board 3. In this horizontal position the daughter printed board 3 is pushed down by the side and rear retainers 10 and 11. The daughter printed board 3 is put in close contact with the opposite side walls 7 of the terminal housing 5. The daughter printed board 3 has notched portions 16 on its opposite front sides. In this horizontal position the daughter board 3 is prevented from slipping off from the connector casing 6 by catching the notched portions 16 of the daughter printed board 3 by the front lateral extensions 12, which are integrally connected to the connector casing 6 (See FIGS. 3 to 6).

As described above, first, the connector casing 6 is attached to the mother printed board 2, and in this fixed position the terminal housing 5 is slidably accommodated in the connector casing 6. Next, the daughter printed board 3 is attached to the connector casing 6, and then each terminal 4 is compressed resiliently with its upper and lower leg contacts 4*a* and 4*b* against the circuit patterns of the overlying and underlying printed boards, thus making a required electrical connection between these circuit patterns.

In this particular embodiment the connector casing 6 is attached with the aid of visible attachment extensions 13. In place of such visible attachment extensions the connector casing 6 may have pegs (not shown) on its under surface, and a printed board may have holes. The connector casing 6 may be fixed to the underlying printed board with the pegs of the connector casing 6 fitted in the holes of the underlying printed board.

As may be understood from the above, an electrical connector according to the present invention can make an electrical connection between two printed boards with the divergent leg contacts of each terminal in resilient contact with the overlying and underlying printed circuits. Thus, a required electric connection can be made without soldering numerous small terminals of the connector to printed circuits. Therefore, arrangement of numerous small terminals at narrow intervals will cause no difficulty in making a required electrical connection.

I claim:

1. An electrical connector for connecting circuit patterns on two printed boards, comprising:

an insulative terminal housing having a plurality of terminals laterally arranged and fixed at regular intervals each said terminals having two leg contacts extending from the housing;

a connector casing to accommodate said terminal housing, permitting said terminal housing to slide within said connector casing, said connector casing having attachment extensions integrally connected thereto for fixing said connector casing to one printed board whereby when said connector is fixed to said one printed board one leg contact of each terminal is brought into electric contact with the circuit pattern on said one printed board; and means on said connector casing to permit the other printed board to come into contact with the other leg contacts of said terminals and to retain resiliently the other printed board in contact with the other leg contact of each terminal, and, at the same time, retain resiliently said one printed board in contact with one leg contact of each terminal thereby forcing said terminals into resilient contact with said circuit patterns on said two printed boards.

2. An electrical connector according to claim 1 wherein said means to permit the other printed board to come into contact with the other leg contacts of said terminals and to retain resiliently the other printed board in contact with the other contact leg of each terminal, and, at the same time, retain resiliently said one printed board in contact with one leg contact of each terminal, comprising a stopper wall integrally connected to said terminal housing, an upper rear retainer and upper opposite side retainers all of which are integrally connected to said connector casing whereby the other printed board is inclined and inserted in a space defined by said stopper wall and said upper rear retainer, allowing the other printed board to come to contact with said stopper wall and said upper rear retainer; and whereby when the other printed board is pivotably rotated said other printed board contacts said rear retainer until said other printed board has been caught by said side retainers, thereby retaining the circuit pattern on the other printed board in resilient contact with the other leg contacts of said terminals.

3. An electric connector according to claim 2 further including means to prevent the other printed board having notched portions on opposite sides from slipping off from said connector casing in the horizontal direction, said means comprising front lateral extensions integrally connected to said connector casing whereby said notched portions are caught by said front lateral extensions.

4. An electrical connector according to claim 1 wherein said terminal housing also includes outwardingly extending nibs and said connector casing having walls with slots formed therein which slots slidably engage said nibs thereby aligning the terminal housing with said connector casing while said terminal housing slides within said connector casing.

* * * * *